US007897244B2

(12) United States Patent
Dieb

(10) Patent No.: US 7,897,244 B2
(45) Date of Patent: Mar. 1, 2011

(54) SEALING BAND

(75) Inventor: Martin Dieb, Abtsgmund (DE)

(73) Assignee: ISO-Chemie GmbH (DE)

( * ) Notice: Subject to any disclaimer, the term of this patent is extended or adjusted under 35 U.S.C. 154(b) by 180 days.

(21) Appl. No.: 12/103,546

(22) Filed: Apr. 15, 2008

(65) Prior Publication Data

US 2008/0303226 A1 Dec. 11, 2008

(30) Foreign Application Priority Data

Apr. 17, 2007 (EP) ..... 07007803

(51) Int. Cl.
*B32B 3/12* (2006.01)
*B32B 3/26* (2006.01)
*B32B 3/10* (2006.01)

(52) U.S. Cl. ..... 428/156; 428/158; 428/131; 428/137; 428/304.4; 428/314.4

(58) Field of Classification Search ..... 428/156, 428/158, 159, 160, 167, 304.4, 312.2, 314.4, 428/317.1, 322.7, 131, 134, 136, 137; 277/650; 52/309.4, 309.5, 309.6
See application file for complete search history.

(56) References Cited

U.S. PATENT DOCUMENTS 3,582,095 A 6/1971 Bogaert

FOREIGN PATENT DOCUMENTS

| | | | |
|---|---|---|---|
| DE | 19 37 394 | | 2/1971 |
| DE | 3409535 A | * | 10/1984 |
| DE | 39 21 777 | | 10/1990 |
| DE | 298 13 307 | | 12/1999 |
| EP | 976882 A2 | * | 2/2000 |

* cited by examiner

*Primary Examiner*—Jennifer C McNeil
*Assistant Examiner*—Catherine Simone
(74) *Attorney, Agent, or Firm*—Jansson Shupe & Munger Ltd.

(57) ABSTRACT

The joint-sealing tape of flexible foam material (2) capable of recovery after compression is saturated with an impregnate and provided with a plurality of notches or recesses (4*a*, 4*b*, 4*c*, 4*d*), which serve to accept and to distribute the impregnate in the foam (2).

9 Claims, 2 Drawing Sheets

SEALING BAND

CROSS REFERENCE TO RELATED APPLICATION

This application claims priority to European patent application EP 07 007 803.5, filed Apr. 17, 2007.

FIELD OF THE INVENTION

The present invention relates to the field of foam tapes for creating sealing joints against rain, air, wind, and sound and/or to insulate against heat loss, such as in the construction industry.

BACKGROUND OF THE INVENTION

These types of joint-sealing tapes usually consist of polyethylene or polyurethane foam, and are used, for example, in the construction industry, where the joints between window frames or door frames and the masonry must be sealed. The foam materials have a cellular structure made up of webs with pores between them. The spectrum of flexible foams extends from closed-cell foams, which allow virtually no air to pass through, to open-cell foams, which have relatively high permeability to air. At least the open-cell foams are usually saturated with an impregnate to achieve the desired sealing properties. Such impregnates also lead to a delayed recovery of the foam after its compression, because the impregnates usually contain adhesive substances, which settle on the cell webs of the foam structure and adhere there. Use is often made of the delayed recovery effect when joints are to be sealed, in that the foam is first compressed and inserted into the joint to be sealed, whereupon the foam partially reexpands to assume its functional state and seals the joint. The impregnate can also be used to obtain other positive properties such as fire safety properties or protection against UV radiation.

To obtain joint-sealing tapes with extremely high sealing values, it is also desirable to impregnate foams with relatively closed cells, as described in EP 1 600 571 A1. Nevertheless, the complete saturation of relatively closed-cell foams is very difficult and is also subject to limitations with respect to the choice of impregnation agent.

Saturation with high-viscosity impregnates is difficult to achieve even in the case of open-cell foams. And it is been almost completely impossible so far to impregnate completely closed-cell foams.

It is therefore an object of the present invention to create a joint-sealing tape of flexible foam capable of recovery after compression which can be impregnated very easily and which also achieves extremely high sealing values.

SUMMARY OF THE INVENTION

The invention is a joint-sealing tape of flexible foam capable of recovery after compression is thus provided, where the joint-sealing tape is saturated with an impregnate and is provided with a plurality of notches or recesses, which serve to accept and to distribute the impregnate in the foam. The notches or recesses are much deeper than they are wide in the functional direction of the joint-sealing tape.

As a result of this design, all types of foam can be impregnated with relatively little effort. Thus, for example, relatively closed-cell foams can be impregnated more easily and more homogeneously; open-cell foams can even be saturated with high-viscosity impregnates; and even completely closed-cell foams can be provided with an impregnate in the area of the notches or recesses by surface adhesion, as a result of which the desired properties attributable to the impregnate such as delayed recovery can be achieved.

The notches or recesses in the foam are preferably arranged in such a way that they have little or no negative effect on the sealing action in the functional direction of the joint-sealing tape. Thus the inventive joint-sealing tape does not suffer from any disadvantages at all versus the conventional joint-sealing tape in this respect either.

According to the invention, the dimension of the notches or recesses in the longitudinal direction of the joint-sealing tape is at least as long as the dimension of the notches or recesses in the transverse direction of the joint-sealing tape. As a result, the sealing effect in the transverse direction of the joint-sealing tape is kept nearly constant, whereas the overall area of the notches or recesses in the foam is maximized for the sake of optimal saturation.

To simplify the production of the inventive joint-sealing tape, the notches or recesses are distributed over the foam in regular patterns.

In one embodiment of the inventive joint-sealing tape, the notches or recesses extend through the entire thickness of the joint-sealing tape, as a result of which the production process can be implemented even more easily.

In another embodiment, the notches or recesses extend only part of the way through the thickness of the foam from the top surface and from the bottom surface of the joint-sealing tape with an offset between the two sets. As a result, the number of notches or recesses in the foam can be easily increased, and thus the homogeneity with which the foam is impregnated can be improved. Generally speaking, it is now possible for the impregnate to penetrate into areas of the foam which were previously inaccessible.

A joint-sealing tape with extremely high sealing values can be obtained by forming the inventive joint-sealing tape out of a relatively closed-cell foam with low permeability to air.

The impregnate preferably improves the sealing properties of the joint-sealing tape and also has adhesive properties, which lead to the delayed recovery of the joint-sealing tape after it has been compressed. In the construction industry, this makes the joint-sealing tape easier to handle.

To save material and at the same time to preserve the sealing properties of the joint-sealing tape in the functional direction, the notches are preferably formed as displacement cuts.

DESCRIPTION OF THE DRAWINGS

Additional details, features, and advantages of the present invention can be derived from the following description, which refers to the attached drawings.

DETAILED DESCRIPTION OF A PREFERRED EMBODIMENT

Figure 1A:
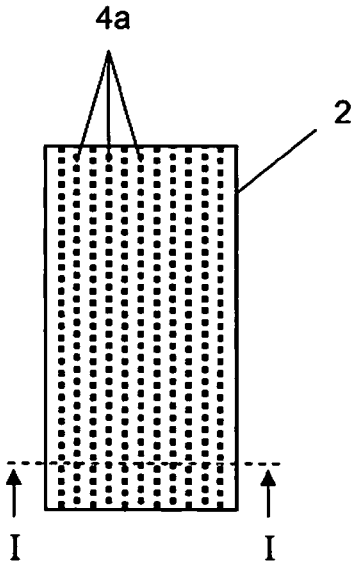
FIG. 1*a* shows a top view of a first embodiment of the inventive joint-sealing tape with dot-like notches.

FIG. 1*a* shows a top view of a first embodiment of an inventive joint-sealing tape. The joint-sealing tape consists of flexible foam 2, which can be formed out of a relatively open-cell foam material with high air permeability. Preferably, however, it is a relatively closed-cell foam material with low permeability and small pore cross sections. Foams with air permeability values which are between the two extremes just mentioned above can also be used within the scope of the present invention. Preferred foam materials are polyurethane and polyethylene foams which are able to recover their original state completely or almost completely after having been compressed. The dimensions of the joint-sealing tape are not shown to scale in FIG. 1*a*, because a joint-sealing tape usually extends much farther in the longitudinal direction and is therefore wound up into a roll. The inventive joint-sealing tape shown in FIG. 1*a* therefore represents merely a section of the overall length of the tape.

Figure 1B:
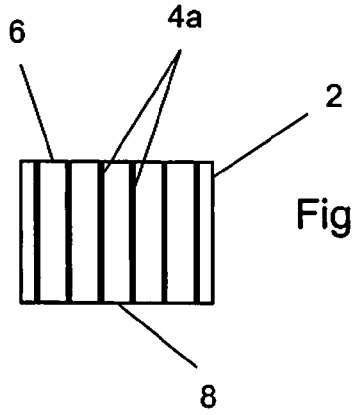
FIG. 1*b* shows a transverse cross section through the joint-sealing tape along line I-I of FIG. 1*a*, from which it can be seen that the notches extend through the entire thickness of the joint-sealing tape.

In the top view of FIG. 1*a*, we can see many notches or recesses 4*a*, which have been introduced into the foam 2 in offset longitudinal rows; they are preferably cut into the foam. As can be seen in FIG. 1*b*, which shows a cross section along line I-I of FIG. 1*a*, the notches or recesses 4*a* in this special embodiment pass through the entire thickness of the foam 2 and thus form a connection between the top surface 6 and the bottom surface 8 of the joint-sealing tape. The distance between adjacent longitudinal rows of notches 4*a* is usually in the range of 1-5 mm, as is the distance between two dot-shaped notches 4*a* within one of the longitudinal rows. In the case of wide joint-sealing tapes or joint-sealing tapes of considerable thickness for larger joints, the rows and notches can be farther apart without detriment to the effectiveness of the strip.

As a result of the notches or recesses 4*a*, an impregnate penetrates very easily into the interior regions of the foam, so that even foams 2 with a high percentage of closed cells can be almost completely and homogeneously impregnated. The impregnate preferably has adhesive properties, so that the recovery of the foam 2 after its compression is delayed. In addition, the impregnate has the effect of even further increasing the sealing properties against air and driving rain. The impregnate can also have fire-retardant properties as well as UVR protection properties. Conventional impregnates are produced on the basis of aqueous acrylate dispersions, polyurethane dispersions, silicones, silicates, ethylene-vinyl acetates, polyvinyl acetates, or waxes, but other resin-containing impregnates or other known impregnating agents such as bitumen can also be considered.

Figure 2A:
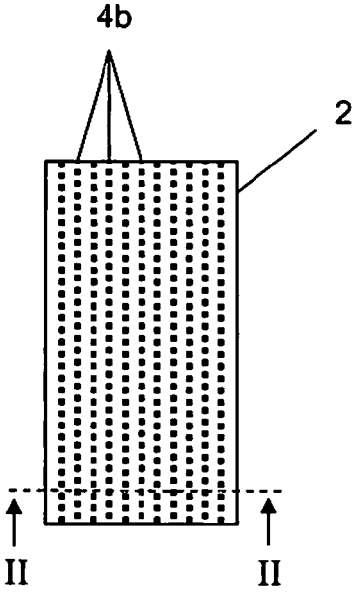
FIG. 2*a* shows a top view of a second embodiment of the inventive joint-sealing tape with dot-like notches.
Figure 2B:
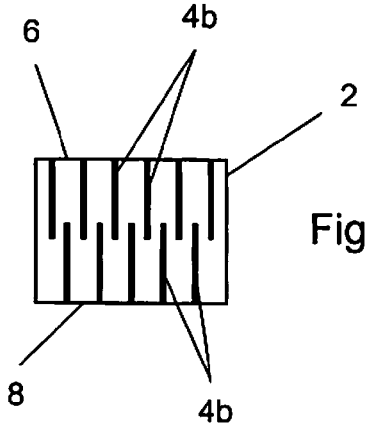
FIG. 2*b* shows a transverse cross section through the joint-sealing tape along line II-II of FIG. 2*a*, from which it can be seen that the notches extend about halfway through the thickness of the foam from both the top surface and from the bottom surface with a certain offset between the two sets of notches.

The second embodiment shown in FIGS. 2*a* and 2*b* differs from the first embodiment in that the upper notches 4*b*, which extend into the foam 2 from the top surface 6 of the foam strip, extend only about half-way through the thickness of the foam 2, whereas identical notches 4*b*, offset from the first set of notches, extend about half-way through the thickness from the bottom surface 8 of the foam 2. As a result, the notches do not have to penetrate as deeply into the foam 2, but it is still ensured that the foam 2 will be completely saturated.

Figure 3A:
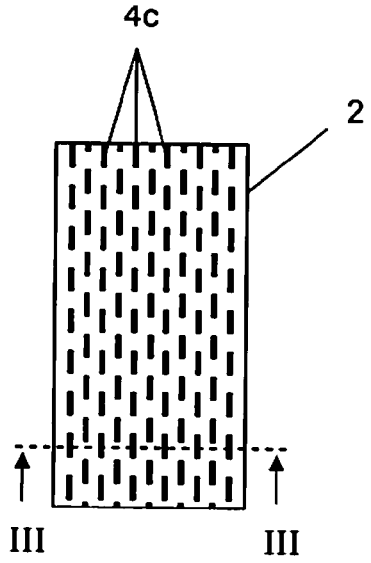
FIG. 3*a* shows a top view of a third embodiment of the inventive joint-sealing tape with strip-like notches extending in the longitudinal direction of the joint-sealing tape.
Figure 3B:
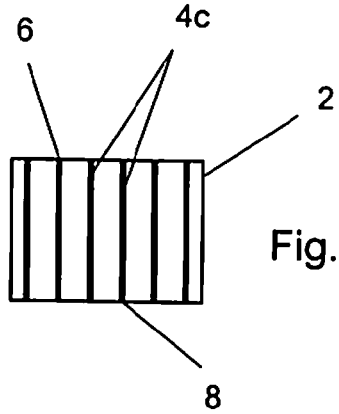
FIG. 3*b* shows a transverse cross section through the joint-sealing tape along line I-III of FIG. 3*a*, from which it can be seen that the notches extend through the entire thickness of the foam.

An especially advantageous third embodiment of the joint-sealing tape is shown in FIGS. 3*a* and 3*b*. The difference from the embodiment of FIGS. 1*a* and 1*b* is that the notches 4*c* are lengthened in the longitudinal direction of the joint-sealing tape and thus form strip-like, longitudinal notches. As a result, the perforated component of the foam 2 is increased in the longitudinal direction, and superior saturation of the foam 2 with the impregnate is achieved. The length of the individual strip-like longitudinal notches will usually be in the range of a few millimeters, but almost any length can be selected. The value chosen will depend on, among other things, the dimensions of the foam.

Figure 4A:
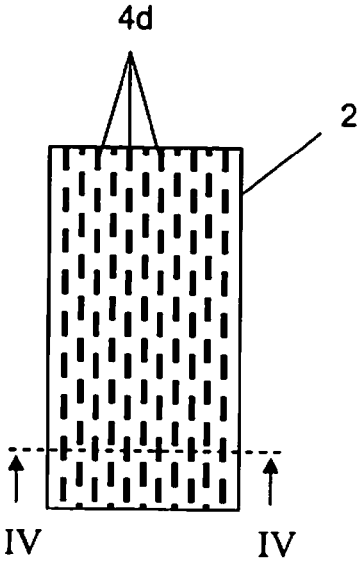
FIG. 4*a* shows a top view of a fourth embodiment of the inventive joint-sealing tape with strip-like notches extending in the longitudinal direction of the joint-sealing tape.
Figure 4B:
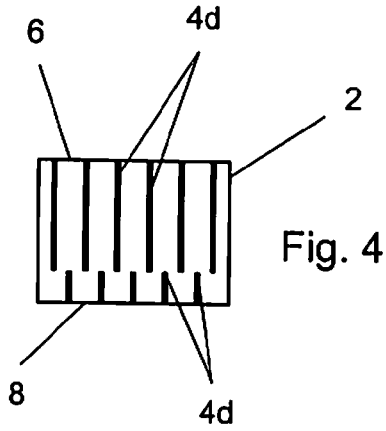
FIG. 4*b* shows a transverse cross section through the joint-sealing tape along line IV-IV of FIG. 4*a*, from which it can be seen that the notches extend into the foam from the top surface and, at an offset from them, from the bottom surface also.

FIGS. 4*a* and 4*b* show a fourth embodiment of the inventive joint-sealing tape, which corresponds to the third embodiment except that the notches 4*d*, as in the case of FIG. 2*b*, do not extend all the way from the top surface 6 of the foam 2 to the bottom surface 8. Instead, lower notches 4*d*, offset from the first set of notches, project into the foam 2 from the bottom surface 8. The individual notches can be of any desired depth.

Many other arrangements and penetration depths of the notches 4*a*-4*d* besides those of the embodiments described above can be imagined. In particular, the notches can also project only from one surface, such as from the bottom surface 8 of the foam 2, without completely penetrating it (penetration depth preferably in the range of 70-99% of the thickness of the foam), as a result of which a comb-like structure is formed. The bottom surface 8 of all the joint-sealing tapes will usually be provided with a layer of pressure-sensitive adhesive covered by a peel-off strip (not shown) so that the tape can be applied to the component to be sealed. This pressure-sensitive adhesive can serve at the same time to hold together the foam material remaining between the notches 4*a*-4*d*, so that the foam 2 will hold its shape even when compressed.

The pattern or structure of the notches 4*a*-4*d* is variable. Depending on the type of foam, a selection can be made from among almost any number of patterns (holes, slots, zigzags, waves, etc.). A more pronounced extension of the notches in the longitudinal direction, however, is especially advantageous with respect to the sealing properties of the joint-sealing tape in the transverse direction, which represents the functional direction of the joint-sealing tape.

The production process of the inventive foam proceeds preferably in the following manner. First, the foam material is produced in large layers, which are then provided with the notches 4*a*. The impregnate is preferably introduced by soaking the foam layers in an immersion bath. In addition to simply allowing the impregnate to penetrate into the notches, compressing and releasing the foam layer several times leads to a suction effect, which draws the impregnate into the notches. The impregnate penetrates into the nearby cell pores in the area of the notches and also in areas of the top surface 6 and bottom surface 8 of the foam and settles there. By making a suitable choice of the size of the notches 4*a* and of the distance between the individual notches, it is therefore possible to achieve a uniformly distributed impregnation of the foam material. After the impregnated foam has dried, a layer of pressure-sensitive adhesive is applied, and the large foam layers are wound up in the compressed state on wide master rolls. These master rolls together with the foam wound up on them are then cut into sections of the desired width, as a result of which narrow rolls of joint-sealing tape are obtained.

The notches or recesses 4*a*-4*d* are preferably cut into the foam by suitably formed knives as displacement cuts, which means that the material is not actually cut out, but merely pushed aside. It also conceivable, however, that material could be stamped out of the foam or that recesses could be formed by means of a water jet cutting machine.

The inventive joint-sealing tape thus provides superior sealing properties and can be easily produced.

The invention claimed is:

1. A joint-sealing tape comprising:

a layer of flexible foam capable of recovering its shape after compression, the foam having a top surface, a bottom surface and two side surfaces which oppose each other in a functional transverse direction;

a plurality of notches or recesses formed into the foam in a direction perpendicular to the functional transverse direction of the foam, the notches or recesses extending into the foam from the top surface or the bottom surface of the foam, each notch or recess having a depth which is greater than its width in the functional direction of the foam penetrating into the interior regions of the foam;

an impregnate which penetrates the foam into nearby cell pores of the foam in an area of the notches or recesses, the notches or recesses accepting and distributing the impregnate into the interior regions of the foam.

2. The joint-sealing tape according to claim 1 wherein the extension of the notches or recesses in the longitudinal direction is at least as great as the extension of the notches or recesses in the transverse direction.

3. The joint-sealing tape according to claim 1 wherein the notches or recesses are distributed over the foam in regular patterns.

4. The joint-sealing tape according to claim 1 wherein the notches or recesses pass through the entire thickness of the joint-sealing tape.

5. The joint-sealing tape according to claim 1 wherein the notches or recesses pass through part of the thickness of the joint-sealing tape.

6. The joint-sealing tape according to claim 5 wherein the notches or recesses extend into the foam from the top surface and from the bottom surface of the joint-sealing tape, the two sets being offset from each other.

7. The joint-sealing tape according to claim 1 wherein it is formed of a relatively closed-cell foam with low air permeability.

8. The joint-sealing tape according to claim 1 wherein the impregnate improves the sealing properties of the joint-sealing tape and also has adhesive properties, which delay the recovery of the joint-sealing tape after it has been compressed.

9. The joint-sealing tape according to claim 1 wherein the notches are formed as displacement cuts.

* * * * *

UNITED STATES PATENT AND TRADEMARK OFFICE

CERTIFICATE OF CORRECTION

PATENT NO. : 7,897,244 B2
APPLICATION NO. : 12/103546
DATED : March 1, 2011
INVENTOR(S) : Deiss It is certified that error appears in the above-identified patent and that said Letters Patent is hereby corrected as shown below:

Title Page, Item (75) Inventor: Martin delete "Dieb" and insert --Deiss--.

In column 3, line 5, delete "I-III" and insert --III-III--.

Signed and Sealed this
Tenth Day of May, 2011

David J. Kappos

David J. Kappos
*Director of the United States Patent and Trademark Office*